United States Patent [19]

Gliha, Jr. et al.

[11] Patent Number: 4,768,977

[45] Date of Patent: Sep. 6, 1988

[54] ELECTRICAL CONTACT WITH TRANSIENT SUPPRESSION

[75] Inventors: Edward R. Gliha, Jr., Bainbridge; Leonard A. Krantz, Jr., Sidney, both of N.Y.

[73] Assignee: Amphenol Corporation, Wallingford, Conn.

[21] Appl. No.: 926,696

[22] Filed: Nov. 3, 1986

[51] Int. Cl.[4] ..... H01R 13/66

[52] U.S. Cl. ..... 439/620; 333/182

[58] Field of Search ..... 339/147 R, 147 P; 333/181, 182, 183, 184, 185; 439/608, 620

[56] References Cited

U.S. PATENT DOCUMENTS

| | | | |
|---|---|---|---|
| 2,912,625 | 11/1959 | Benson | 361/422 |
| 3,275,954 | 9/1966 | Coda et al. | 338/183 |
| 3,388,590 | 6/1968 | Dryden | 73/771 |
| 3,582,862 | 6/1971 | Anderson | 439/608 |
| 4,029,386 | 6/1977 | Krantz, Jr. | 439/608 |
| 4,276,523 | 6/1981 | Boutros et al. | 333/182 |
| 4,431,251 | 2/1984 | Krantz | 439/608 |
| 4,440,463 | 4/1984 | Gliha, Jr. et al. | 439/620 |
| 4,572,600 | 2/1986 | Nieman | 339/147 R |
| 4,582,385 | 4/1986 | Couper et al. | 339/147 R |
| 4,600,262 | 7/1986 | Nieman et al. | 339/147 R |

FOREIGN PATENT DOCUMENTS 2137435A 10/1984 United Kingdom .

*Primary Examiner*—Gil Weidenfeld
*Assistant Examiner*—Gary F. Paumen
*Attorney, Agent, or Firm*—Bacon & Thomas

[57] ABSTRACT

An electrical connector assembly having means for protecting its contacts from adverse voltage surges includes protectively terminating one terminal of a silicon diode within a notch formed in the contact and the other terminal with a conductive sleeve encircling the contact body but spaced therefrom. The conductive sleeve is in releasable engagement with a plurality of conductive spring fingers which are integral with a conductive grounding plate whereby a ground path is established between the connector shell and the contact without stressing the diode or its terminations.

7 Claims, 2 Drawing Sheets

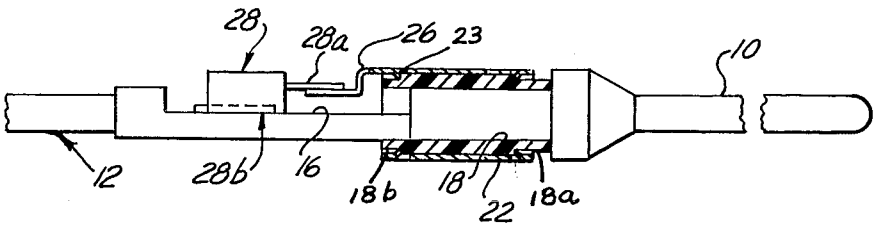
FIG. 2
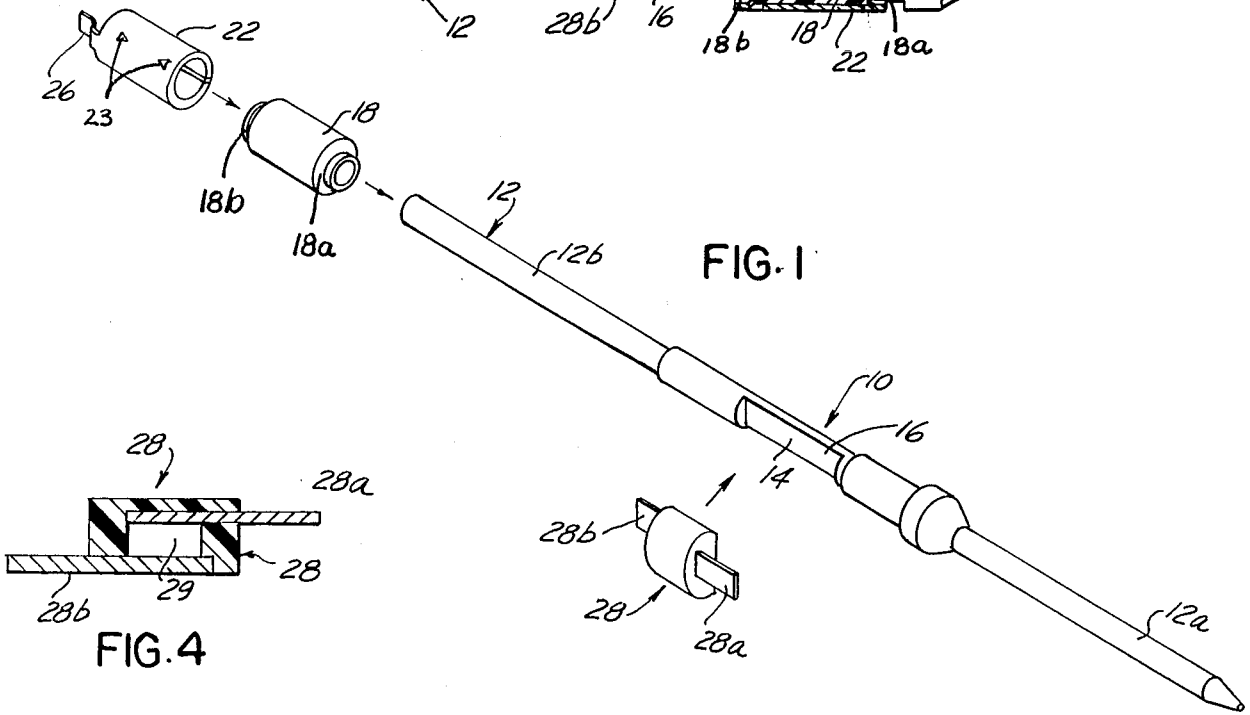
FIG. 1
FIG. 4

FIG.3
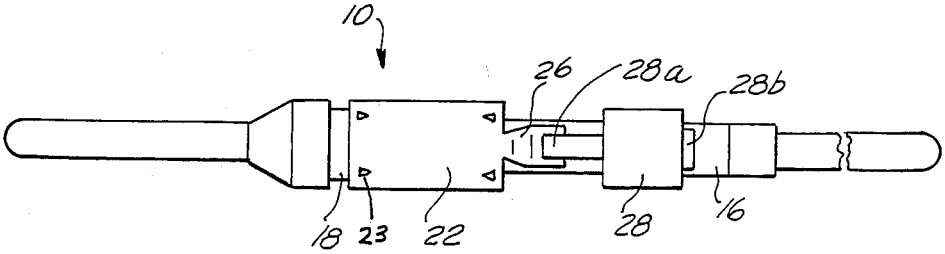
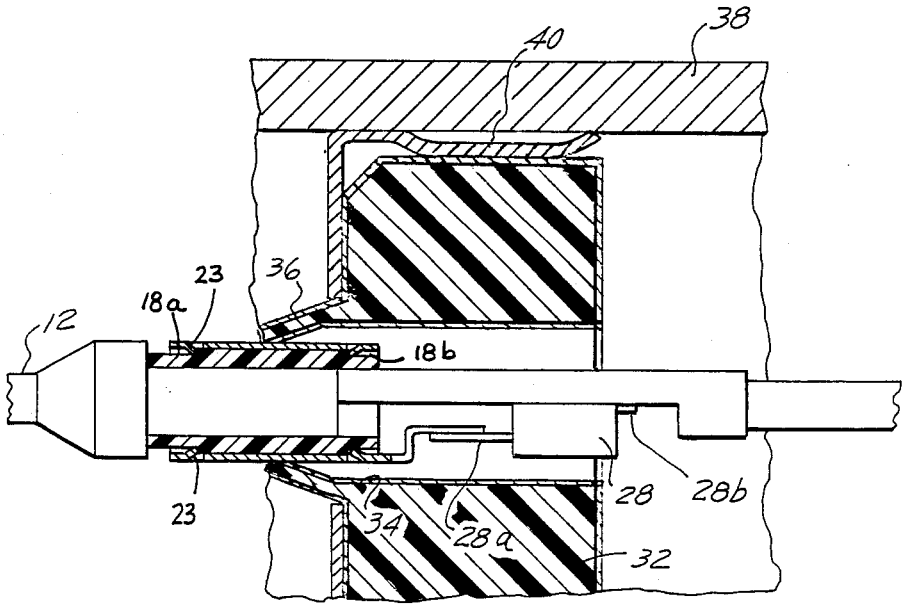
FIG.5

ELECTRICAL CONTACT WITH TRANSIENT SUPPRESSION

This invention relates to an electrical connector assembly having means for protecting its contacts from adverse voltage surges.

Bipolar switching elements, such as a diode, protect sensitive electronic circuits from voltage surges caused by lightning, system transients, static discharges, or nuclear blasts. A diode switches from its steady state stand-by condition when a voltage surge reaches a threshold value and shunts the transient through the diode to the connector housing (i,e,, ground). Conventional units for suppressing electromagnetic pulses in a connector's contacts have been separate from the connector and require diode lead wires. These wires boost installation costs and increase inductance, which slows response time and thus prolongs the period of circuit vulnerability.

U.K. patent application 2 137 435 "Contact Element Of An Electrical Connector Embodying a Circuit Component" mounts in a medial notch of each contact a pair of electronic components with an outwardly bowed spring beam having its opposite ends connected to one respective component and its bowed portion completing an electrical circuit path with a ground plate carried in the connector shell, each component being connected to the contact and comprising a bipolar diode for transient suppression or a capacitor for filtering. Each contact is removably insertable into an opening of the ground plate whereby the spring beam is compressed.

While this approach places the diodes within the connector to reduce the conductive path to ground, provision of the bridging spring between diodes will increase ground impedance and place spring forces on the diodes and their electrical connection to the contact. Semiconductor diodes are very thin chips of silicon that will break easily under shear loads and thus should be protected during movement or from external forces. Four electrical connections for the two diodes increases the chance that active forces on the spring beam, such as would be presented during vibration and shock, will disrupt the ground path thereby either leading to failure of the connector or damage to the unit the connector was to protect.

It would be desirable to provide a connector with transient suppression protection with maintains a short conductive path to ground, protects a diode from mechanical stresses by being isolated from loads during installation/removal of the contact, and has an electrical circuit path to ground comprising multiple contact points with the contact.

In an electrical connector member is provided an electrical connector shell, a grounding plate in the shell and in electrical contact therewith, an opening extending through the plate, a contact body mounted in the opening, an electrical component mounted on the side of the contact thereby, and connecting means for electrically connecting the electrical component to the plate. In particular, the connecting means are characterized by a conductive ground sleeve encircling the contact body and spaced therefrom, a plurality of resilient conductive spring fingers extending from the ground plate and making releasable contact with the ground sleeve, and the electrical component free from contact by the spring fingers and having a pair of terminals one and the other terminal being non-releasably connected electrically, respectively, to the ground sleeve and the contact body.

Advantages of a connector member provided herein is usability of a diode package that is less costly and does not require delicate grounding springs and placeable in standard connectors already available to users in the field.

The invention will now be described, by way of example, with reference to the accompanying drawings in which:

FIG. 1 is an exploded assembly view of a contact having a transient suppression diode component.

FIG. 2 is an enlarged side view in section of the assembled contact.

FIG. 3 is an enlarged plan view of the assembled contact.

FIG. 4 is an enlarged side view in section of the diode component.

FIG. 5 is an enlarged side view in section showing the contact mounted in an opening of a grounding plate.

The present invention is an improvement upon U.S. Pat. No. 4,029,386 "Connector Having a Plated Plastic Ground For Filter Contacts", issued June 14, 1977 to Krantz, Jr et al, the specification and drawings thereof being specifically incorporated herein by reference. An electrical connector member, such as that shown by FIG. 1 of the Krantz, Jr. et al patent, includes a conductive cylindrical connector shell 38, a conductive cylindrical grounding plate (i.e., wafer) 32 having an opening 34 extending therethrough, a contact body 12 mounted in the opening, and a conductive cylindrical annular metallic band 40 (i.e., a shallow cup-shaped ground ring) carried in the shell, the grounding plate 32 being seated in the band 40 and the band being interposed between the inner wall of the shell and the outer periphery of the ground plate and engaging each whereby to complete an electrical circuit path therebetween. An electrical circuit component is mounted onto the contact body to filter or otherwise protect an electrical signal passing therethrough and connecting means electrically connect the electrical circuit component to the grounding plate.

Turning now to FIG. 1 and according to this invention, a contact 10 having transient suppression protection comprises an elongated generally cylindrical conductive contact body 12 having opposite ends **12*a*,12*b* for mating and a medial notch 14 for receiving a semiconductor diode component 28. The notch extends axially and defines along one side of the contact body a non-concentric rectangular support surface 16** for receiving the diode component.

A generally cylindrical hollow insulator sleeve 18 is sized to interference fit about the rearward end **12*b* of the contact body whereby to resist relative (axial or rotational) movement therebetween, each opposite end portion of the sleeve having stepped ends 18*a*, 18*b***.

A generally cylindrical, longitudinally slit, hollow conductive ground sleeve 22 having pointed retention barbs 23 spaced thereabout is sized to fit about the insulator sleeve whereby its barbs will seat against the stepped ends **18*a*, 18*b* of the insulator sleeve, the barbs being sharp to bite into the insulator sleeve whereby to prevent relative axial and rotational movement thereabout. The ground sleeve has a shaped tab 26** extending radially rearward and inward from one sleeve edge.

The diode 28 has a pair of rectangular shaped conductive terminals **28*a*, 28*b* extending therefrom for electrical connection, respectively, to the support surface 16 and the tab 26**.

FIG. 2 shows the assembled contact 10. The ground sleeve 22 has been inserted over and about the insulator sleeve and its barbs deflected radially inward to seat against the ends of the insulator sleeve. The respective diode terminals 28*a*,28*b* have been soldered or otherwise electrically and mechanically secured to the tab and the ground sleeve.

FIG. 3 is an enlarged plan view of the assembled contact 10. The width of each respective termination between diode terminals 28*a*, 28*b* and contact body is substantially the same as the width defining the support surface 16 or tab 26 where to reduce ground impedance.

The diode is mounted to the contact body to achieve the closest coupling to the silicon diode. The diode has a response time to signals above its "turn-on" voltage in the area of $10^{-12}$ seconds (i.e., close to the speed of light). However lead attachments reduce the diode response time. The subject design will achieve a response time of $10^{-9}$ seconds or less and protect against signals in excess of 1,000 V which rise to their peak in $5\times10^{-9}$ seconds. Prior art has not achieved this goal.

FIG. 4 is an enlarged side view in section of the diode compartment 28. The diode is a semiconductor and defines a single p-n junction of silicon 28 between the two terminals 28*a*,28*b*.

FIG. 5 is an enlarged side view in section showing the connecting means characterized by the cylindrical conductive ground sleeve 22 encircling the contact body 12 and spaced therefrom by the insulator sleeve 18, the contact 10 disposed in opening 34 of the grounding plate, a plurality of resilient conductive spring fingers 36 extending from the grounding plate 32 and making releasable contact with the ground sleeve 22, and the diode 28 having the terminals 28*a*,28*b* one and the other being non-releasably connected electrically, respectively, to the ground sleeve 22 and the contact body 12.

Having thus described the invention what is claimed is:

1. An electrical connector member comprising a conductive connector shell, a conductive grounding plate in the shell and in electrical contact therewith, said plate having a plurality of integral conductive spring fingers extending therefrom, an opening extending through the plate, a conductive contact body having a longitudinal axis and mounted in the opening, an electrical component mounted on the side of the contact body and connecting means for electrically connecting the electrical component to the plate, said connecting means comprising a conductive ground sleeve encircling said contact body but spaced therefrom and releasably engaging said integral conductive spring fingers of said conductive grounding plate, and said electrical component having a pair of conductive terminals being electrically and mechanically connected to said ground sleeve and said contact body, respectively, said ground sleeve being longitudinally offset from and not being in direct mechanical contact with said electrical component.

2. The connector member as recited in claim 1 wherein said plurality of spring fingers extend from said ground plate and converge together to releasably engage the outer periphery of said ground sleeve of the contact body disposed in the opening.

3. The connector member as recited in claim 1 wherein an insulator sleeve is interposed between the contact body and the ground sleeve.

4. The connector member as recited in claim 3 wherein the contact body is generally cylindrical and includes a notch therein forming a supporting surface, said ground sleeve is generally cylindrical and includes barbs which seat against opposite ends of the insulator sleeve and an elongated tab which extends inwardly to the supporting surface, and said terminals are non-releasably connected to the supporting surface and the tab.

5. The connector member as recited in claim 4 wherein said terminals are substantially flat with their transverse width being substantially equal to the width, respectively, of the ground sleeve and support surface to which connected.

6. The connector member as recited in claim 4 wherein conductive electrical epoxy electrically and mechanically secures said terminals and electrical component within the notch, to said contact body and said ground sleeve.

7. The connector member as recited in claim 1 wherein said electrical component comprises a semiconductor diode.

* * * * *